US010036557B2

(12) United States Patent
Ceccoli

(10) Patent No.: US 10,036,557 B2
(45) Date of Patent: Jul. 31, 2018

(54) GAS BURNER ASSEMBLY FOR A COOKING HOB

(71) Applicant: Electrolux Appliances Aktiebolag, Stockholm (SE)

(72) Inventor: Carlo Andrea Ceccoli, Nürnberg (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 331 days.

(21) Appl. No.: 14/818,754

(22) Filed: Aug. 5, 2015

(65) Prior Publication Data

US 2016/0091210 A1 Mar. 31, 2016

(30) Foreign Application Priority Data

Sep. 30, 2014 (EP) ..... 14186938

(51) Int. Cl.
*F24C 3/08* (2006.01)
*F24C 15/10* (2006.01)
(Continued)

(52) U.S. Cl.
CPC ..... *F24C 15/107* (2013.01); *F23D 14/06* (2013.01); *F23D 23/00* (2013.01); *F24C 3/085* (2013.01);
(Continued)

(58) Field of Classification Search
CPC ..... F23D 14/06; F23D 23/00; F23D 2900/14062; F23D 2203/1015; F23D 2212/20; F23D 2900/14005; F23D 2900/14064; F23D 2900/14061; F23D 2900/14063; F23D 14/08; F24C 3/85; F24C 15/107; F24C 3/085; A47J 37/0682
(Continued)

(56) References Cited

U.S. PATENT DOCUMENTS 567,659 A * 9/1896 Ruppel ..... F23D 11/44 431/225
3,638,635 A 2/1972 Drennan
(Continued)

FOREIGN PATENT DOCUMENTS

WO 2011144630 11/2011

OTHER PUBLICATIONS

European Search Report for EP14186938, dated Mar. 15, 2017, 7 pages.

*Primary Examiner* — Alfred Basichas
(74) *Attorney, Agent, or Firm* — Pearne & Gordon LLP

(57) ABSTRACT

A gas burner assembly for a cooking hob, in particular for a domestic cooking hob, includes at least two burner bases arranged side-by-side-and a burner crown element arranged or arrangeable above the burner bases. At least one burner cap is arranged or arrangeable above the burner crown element. The burner bases are adjustable separately. The burner crown element includes a bottom plate subdivided into at least two portions arranged side-by-side. Each portion of the bottom plate is arranged or arrangeable above one of the burner bases. The burner crown element includes at least two side walls. Each side wall encloses one of the portions of the bottom plate. The burner crown element includes flame ports formed in the side walls. The flame ports are arranged in those sections of the side walls arranged opposite to the adjacent portion or portions of the bottom plate.

13 Claims, 5 Drawing Sheets

Figure 1:
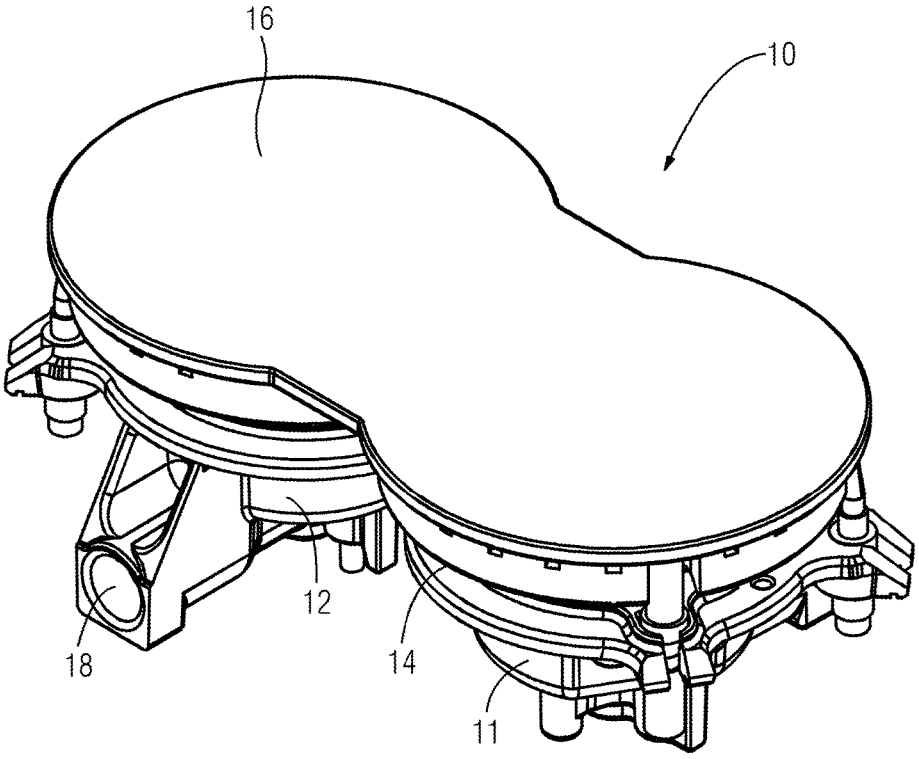

(51) Int. Cl.
*F23D 14/06* (2006.01)
*F23D 23/00* (2006.01)

(52) U.S. Cl.
CPC .. *F23D 2203/1015* (2013.01); *F23D 2212/20* (2013.01); *F23D 2900/14005* (2013.01); *F23D 2900/14061* (2013.01); *F23D 2900/14062* (2013.01); *F23D 2900/14063* (2013.01); *F23D 2900/14064* (2013.01)

(58) Field of Classification Search
USPC ..... 126/216
See application file for complete search history.

(56) References Cited

U.S. PATENT DOCUMENTS

| | | | | |
|---|---|---|---|---|
| 5,690,483 | A * | 11/1997 | Oda | F23D 14/06 126/39 E |
| 8,011,358 | B2 * | 9/2011 | Galindo | F23D 14/06 126/39 E |
| 2005/0142511 | A1 * | 6/2005 | Yam | F23D 14/06 431/285 |
| 2008/0202495 | A1 | 8/2008 | Caloca | |

* cited by examiner

GAS BURNER ASSEMBLY FOR A COOKING HOB

The present invention relates to a gas burner assembly for a cooking hob. In particular, the present invention relates to a gas burner assembly for a domestic cooking hob. Further, the present invention relates to a cooking hob including at least one gas burner assembly.

A conventional cooking hob comprises one or more gas burner assemblies. Usually, one gas burner assembly is provided for one cooking pot or pan. The cooking hob may comprise gas burner assemblies having different heating powers adapted to the sizes of the cooking pots or pans. The heating power of each gas burner assembly is adjustable separately. Thus, the cooking temperature in each cooking pot or pan can be adjusted independently.

However, various kinds of food stuff require different cooking temperatures. Thus, a separate cooking pot or pan and a separate gas burner assembly are required for each kind of food stuff. This results in a big effort.

It is an object of the present invention to provide a gas burner assembly for a cooking hob, which allows the cooking of different kinds of food stuff by low complexity.

The object is achieved by the gas burner assembly according to claim 1.

According to the present invention a gas burner assembly is provides for a cooking hob, in particular for a domestic cooking hob, wherein

- the gas burner assembly comprises at least two burner bases arranged side-by-side,
- the gas burner assembly comprises a burner crown element arranged or arrangeable above the at least two burner bases,
- the gas burner assembly comprises at least one burner cap arranged or arrangeable above the burner crown element,
- the at least two burner bases are adjustable separately,
- the burner crown element includes a bottom plate subdivided into at least two portions arranged side-by-side,
- each portion of the bottom plate is arranged or arrangeable above one of the at least two burner bases,
- the burner crown element includes at least two side walls,
- each side wall encloses one of the at least two portions of the bottom plate,
- the burner crown element includes a plurality of flame ports formed in the side walls, and
- the flame ports are arranged in those sections of the side walls arranged opposite to the adjacent portion or portions of the bottom plate.

The core of the present invention is the use of at least two separately adjustable burner bases on the one hand and the arrangement of the flame ports in those sections of the side walls arranged opposite to the adjacent portion or portions of the bottom plate. Therefore, groups of flame ports are arranged at opposite outer sides of the gas burner assembly, wherein each group of flame ports corresponds with one of the burner bases. In particular, the groups of flame ports corresponding with one of the burner bases are spaced from each other. Thus, each group of flame ports may provide different heating powers. Two or more locations above and/or beside outer portions of the gas burner assembly may provide different temperatures, so that various kinds of food stuff may be prepared above and/or beside the one gas burner assembly.

Preferably, the portions of the bottom plate are circular or segments of circles.

For example, the flame ports are recesses at the upper edges of the side walls.

Further, the gas burner assembly may comprise at least two chambers, wherein each chamber is formed by one of the portions of the bottom plate, by the side wall enclosing said portion and by the burner cap above said portion.

Moreover, the burner crown element may be formed as a single-piece part.

In a similar way, the burner cap is formed as a single-piece part.

In particular, the at least two burner bases are identical in construction. This contributes to a low complexity of the gas burner assembly.

In this case, the at least two burner bases may be rotated around a vertical axis relative to each other, so that the gas burner assembly is symmetric in view of a rotation around a vertical axis of 360°/N, wherein N defines the number of burner bases. If the gas burner assembly comprises two burner bases, then the burner assembly is symmetric in view of a rotation around a vertical axis of 180°. If the gas burner assembly comprises three burner bases, then the burner assembly is symmetric in view of a rotation around a vertical axis of 120°. If the gas burner assembly comprises four burner bases, then the burner assembly is symmetric in view of a rotation around a vertical axis of 90°.

According to a preferred embodiment, the bottom plate of the burner crown element includes two circular portions arranged side-by-side, so that the burner crown element, the bottom plate of said burner crown element, the side walls enclosing said bottom plate and/or the burner cap are eight-shaped.

In particular, the flame ports may be arranged at two opposite small sides of the burner crown element.

Further, each burner base comprises at least one spark generator and/or at least one thermocouple element.

For example, the burner bases are made of aluminium cast.

In a similar way, the burner crown element may be made of aluminium cast.

Furthermore, the burner cap may be made of enamelled steel or cast iron.

At last, the present invention relates to a cooking hob, in particular a domestic cooking hob, wherein the cooking hob includes at least one gas burner assembly mentioned above.

Novel and inventive features of the present invention are set forth in the appended claims.

Figure 2:
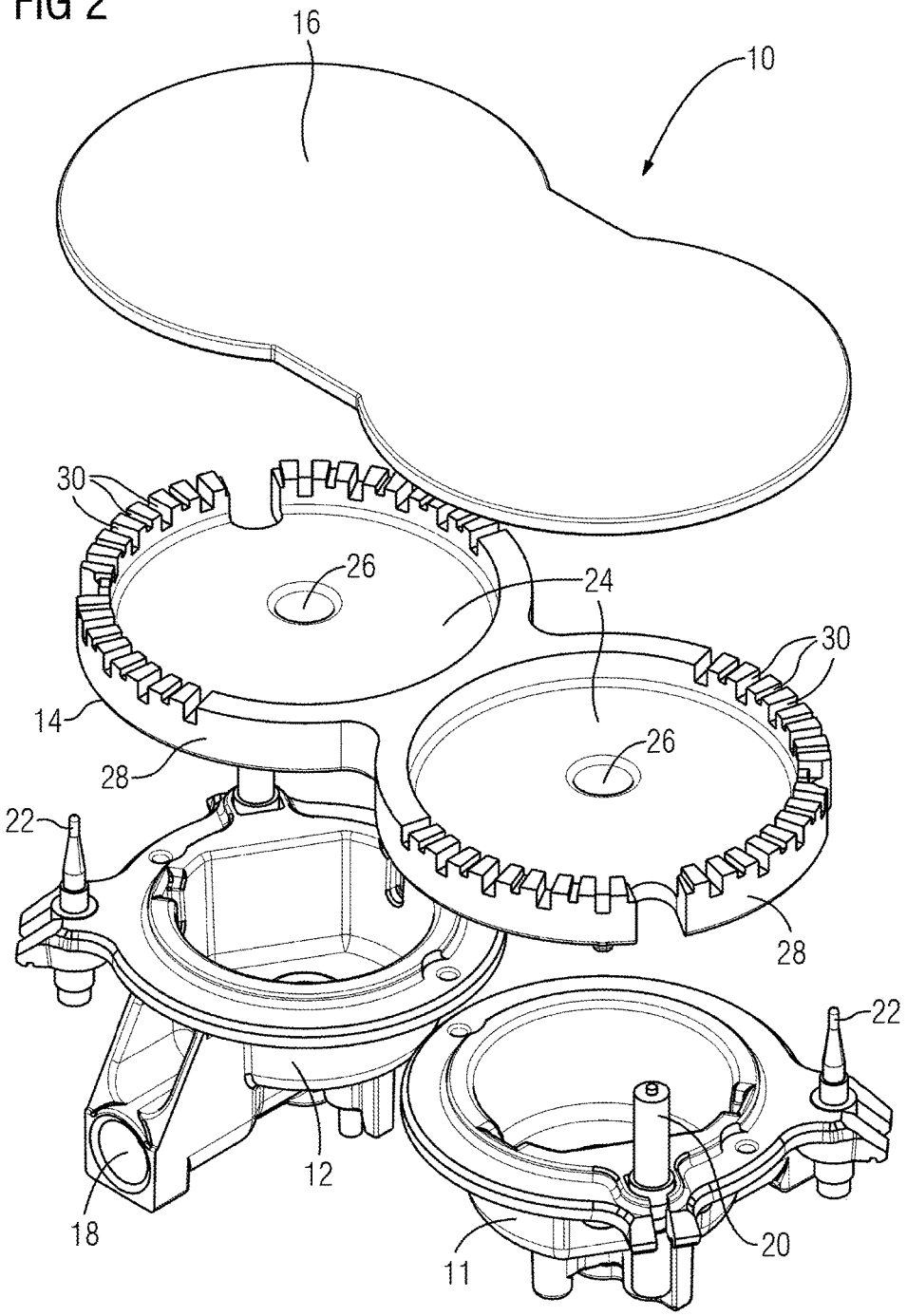
Figure 3:
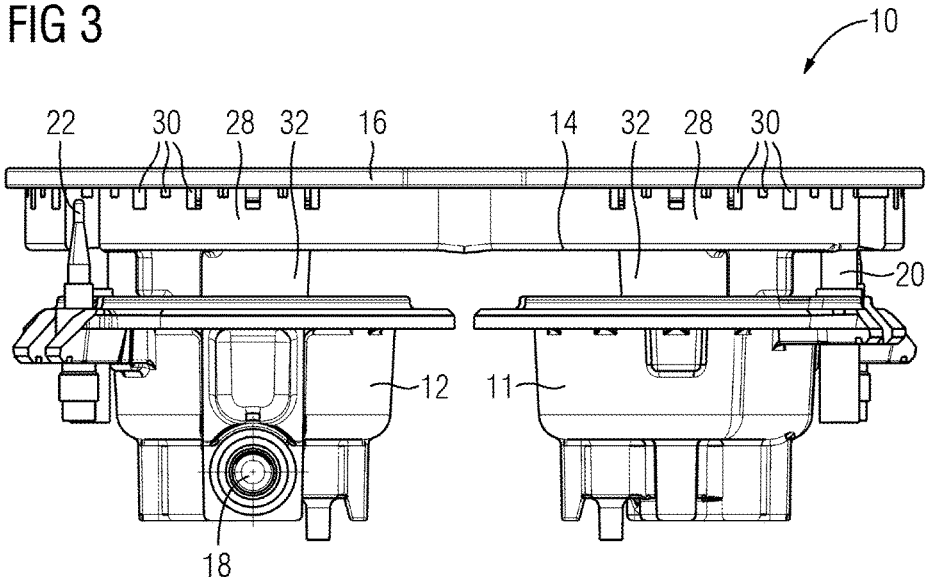
Figure 4:
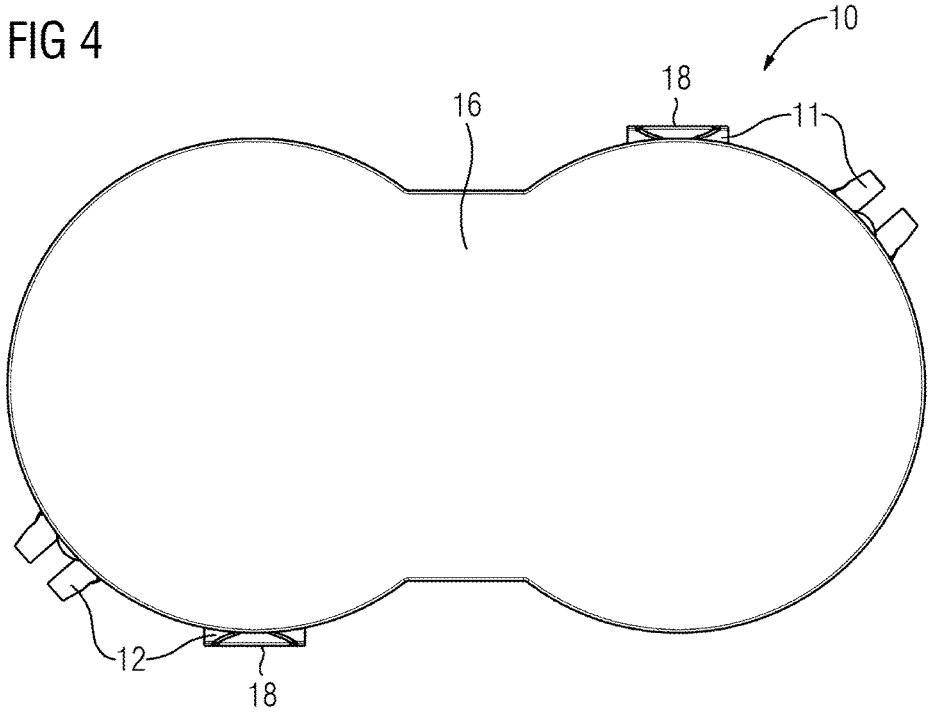
Figure 5:
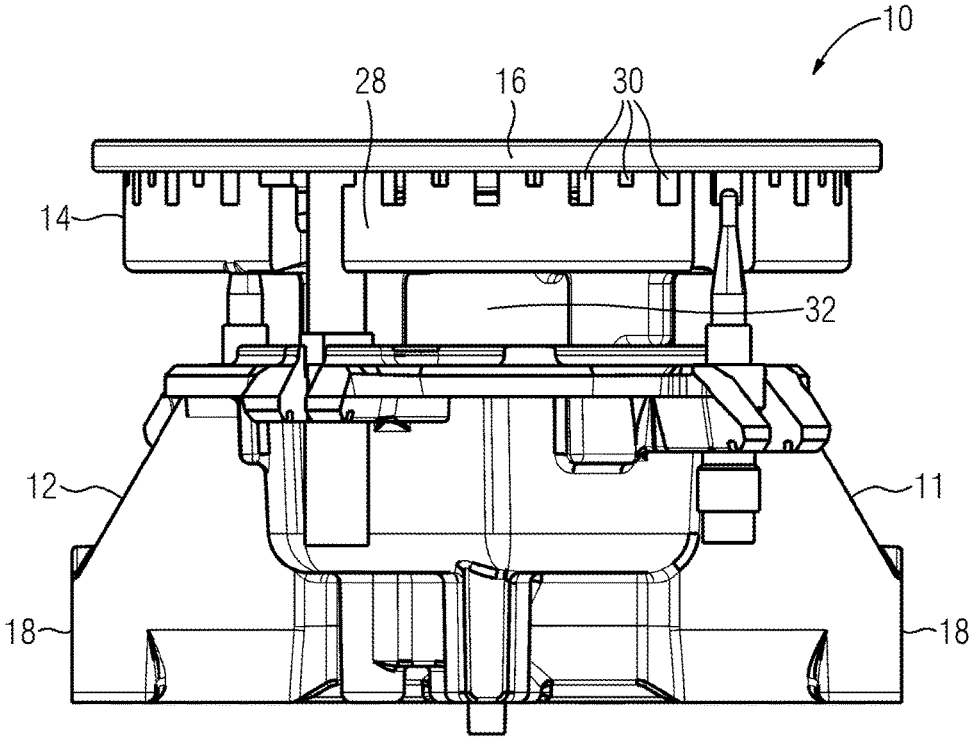
Figure 6:
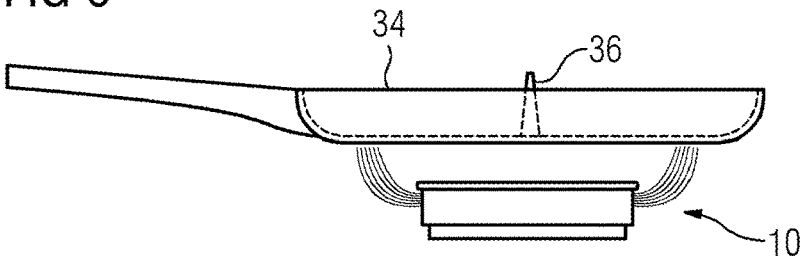
Figure 7:
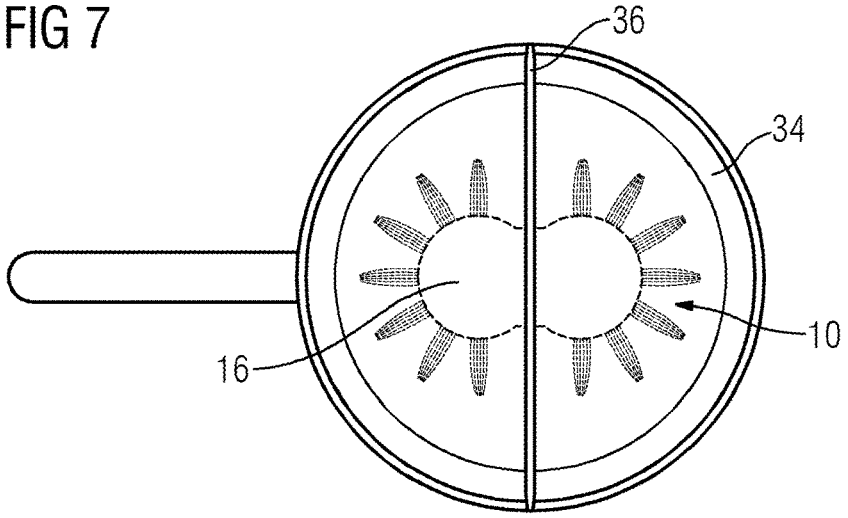
Figure 8:
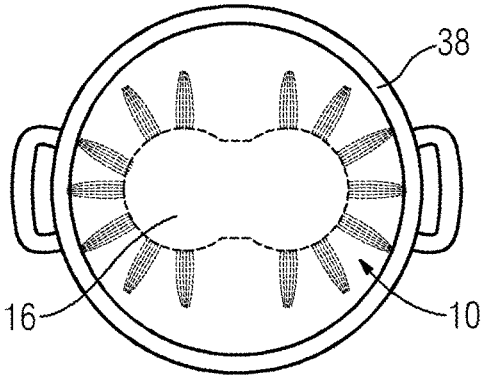

The present invention will be described in further detail with reference to the drawings, in which FIG. 1 illustrates a schematic perspective view of a gas burner assembly according to a preferred embodiment of the present invention, FIG. 2 illustrates a schematic exploded perspective view of the gas burner assembly according to the preferred embodiment of the present invention, FIG. 3 illustrates a schematic front view of the gas burner assembly according to the preferred embodiment of the present invention, FIG. 4 illustrates a schematic top view of the gas burner assembly according to the preferred embodiment of the present invention, FIG. 5 illustrates a schematic side view of the gas burner assembly according to the preferred embodiment of the present invention, FIG. 6 illustrates a schematic side view of a first application of the gas burner assembly according to the preferred embodiment of the present invention, FIG. 7 illustrates a schematic top view of a first application of the gas burner assembly according to the preferred embodiment of the present invention, and FIG. 8 illustrates a schematic top view of a second application of the gas burner assembly according to the preferred embodiment of the present invention.

FIG. 1 illustrates a schematic perspective view of a gas burner assembly 10 according to a preferred embodiment of the present invention. The gas burner assembly 10 comprises a first burner base 11, a second burner base 12, a burner crown element 14 and a burner cap 16. The first burner base 11 and the second burner base 12 are arranged side-by-side. The burner crown element 14 is arranged above the first burner base 11 and second burner base 12. The burner crown element 14 covers the first burner base 11 and second burner base 12. In turn, the burner cap 16 is arranged above the burner crown element 14. The burner cap 16 covers completely said burner crown element 14.

FIG. 2 illustrates a schematic exploded perspective view of the gas burner assembly 10 according to the preferred embodiment of the present invention.

In this example, the first burner base 11 and the second burner base 12 are separated parts and arranged side-by-side. The burner bases 11 and 12 formed as separated parts allow the use of standard burner bases. Alternatively, the burner bases 11 and 12 may be formed as one single-piece part. For example, the burner bases 11 and 12 are made of aluminium cast. Each of the burner bases 11 and 12 includes a gas supply inlet 18. For example, the gas supply inlet 18 is formed as a brass nozzle. Further, each of the burner bases 11 and 12 comprises a spark generator 20 and a thermocouple element 22.

In this example, the first burner base 11 and the second burner M base 12 are identical in construction, wherein the second burner base 12 is rotated 180° around a vertical axis in view of the first burner base 11. The identical burner bases 11 and 12 reduce the complexity of the gas burner assembly 10.

The burner crown element 14 includes a horizontal bottom plate 24. In this example, the bottom plate 24 includes two circular disks arranged side-by-side and plane-parallel to each other. An opening 26 is formed in the centre of each circular disk. Further, the burner crown element 14 includes two side walls 28. Each of said side walls 28 encloses one of the circular disks. At a contact point of the side walls 28, said side walls 28 comprise a common section. Considered from above, the burner crown element 14 and the side walls 28 are eight-shaped. In this example, the burner crown element 14 is formed as a single-piece part.

Moreover, the burner crown element 14 includes a plurality of flame ports 30. The flame ports 30 are formed in the side walls 28 of the burner crown element 14. The flame ports 30 of each side wall 28 are distributed over a portion arranged opposite to the other side wall 28 in each case. In this example, the flame ports 30 are formed as notches in the upper edge of the side wall 28. The gas burner assembly 10 comprises two groups of flame ports 30, wherein said groups are arranged at opposite sides of the gas burner assembly 10.

The burner cap 16 is arranged above the burner crown element 14 and covers completely said burner crown element 14. Two chambers are formed between the burner cap 16 and the burner crown element 14, wherein each side wall 28 encloses one of said chambers. Each chamber is arranged above one of the burner bases 11 and 12. In this example, the burner cap 16 is substantially eight-shaped.

The first burner base 11 and the second burner base 12 are adjustable separately. Thus, different temperatures may be provided above the both groups of flame ports 30.

FIG. 3 illustrates a schematic front view of the gas burner assembly 10 according to the preferred embodiment of the present invention.

The first burner base 11 and the second burner base 12 are separated parts and arranged side-by-side. The gas supply inlet 18 of the second burner base 12 is arranged at the front side, while the gas supply inlet 18 of the first burner base 11 is arranged at the rear side of the gas burner assembly 10.

The burner crown element 14 is arranged above the first burner base 11 and the second burner base 12. A pipe socket 32 extends downwards from each opening 26 in the base plate 24 of the burner crown element 14. Said pipe sockets 32 connect the chambers enclosed by the side walls 28 to the inner spaces of the first burner base 11 and second burner base 12, respectively.

The burner cap 16 is arranged above the burner crown element 14 and covers completely said burner crown element 14. The flame ports 30 are arranged substantially at the small side of the gas burner assembly 10. The one group of the flame ports 30 is arranged at the left hand side, while the other group of the flame ports 30 is arranged at the right hand side of the gas burner assembly.

FIG. 4 illustrates a schematic top view of the gas burner assembly 10 according to the preferred embodiment of the present invention.

FIG. 4 clarifies that the second burner base 12 is rotated 180° around a vertical axis in view of the first burner base 11. The gas supply inlet 18 of the second burner base 12 is arranged at the front side, while the gas supply inlet 18 of the first burner base 11 is arranged at the rear side of the gas burner assembly 10.

FIG. 5 illustrates a schematic side view of the gas burner assembly 10 according to the preferred embodiment of the present invention.

The gas supply inlet 18 of the second burner base 12 is arranged at the front side, while the gas supply inlet 18 of the first burner base 11 is arranged at the rear side of the gas burner assembly 10. The burner crown element 14 is arranged above the first burner base 11 and the second burner base 12. The pipe socket 32 extends downwards from each opening 26 in the base plate 24 of the burner crown element 14, so that the pipe sockets 32 connect the chambers enclosed by the side walls 28 to the inner spaces of the first burner base 11 and second burner base 12, respectively. The burner cap 16 covers completely the burner crown element 14. The flame ports 30 are arranged substantially at the small side of the gas burner assembly 10.

FIG. 6 illustrates a schematic side view of a first application of the gas burner assembly 10 according to the preferred embodiment of the present invention. According to the first application a pan 34 is arranged above the gas burner assembly 10. The pan 34 is subdivided into two portions by a separating plate 36. Said two portions are arranged side-by-side. In this example, the two portions have the same sizes.

The pan 34 is positioned above the gas burner assembly 10 in such a way, that the one group of flame ports 30 is arranged below the one portion of the pan 34, while the other group of flame ports 30 is arranged below the other portion of said pan 34. Since the first burner base 11 and the second burner base 12 are adjustable separately, different temperatures may be provided above the both groups of flame ports 30 and within the both portions of the pan 34.

FIG. 7 illustrates a schematic top view of a first application of the gas burner assembly 10 according to the preferred embodiment of the present invention. The pan 34 is arranged above the gas burner assembly 10, wherein the burner cap 16 of said gas burner assembly 10 is represented by a dashed line. The one group of flame ports 30 is arranged below the one portion of the pan 34, while the other group of flame ports 30 is arranged below the other portion of said pan 34. Different temperatures are provided within the both portions of the pan 34.

The pan 34 and the gas burner assembly 10 allow a multiple cooking within the same pan. Different temperatures are provided in the both portions of the pan 34. For example, meat may be roasted in the one portion by high temperature, while vegetables may be cooked in the other portion by low temperature. Further, couscous and vegetables or sauce may be prepared in the different portions of the pan 34. According to another example, meat may be roasted in the one portion by high temperature, while gravy may be prepared in the other portion by low temperature. Moreover, omelette and bacon may be cooked in the different portions of the pan 34.

FIG. 8 illustrates a schematic top view of a second application of the gas burner assembly 10 according to the preferred embodiment of the present invention. According to the second application a pot 38 is arranged above the gas burner assembly 10, wherein the burner cap 16 of said gas burner assembly 10 is represented by the dashed line. The pot 38 is relative large. The gas burner assembly 10 has a big width, so that the heating of said large pot 38 is improved and the cooking time is reduced.

The bottom plate of the burner crown element 14 mentioned above includes the two adjacent circular disks and two side walls 28 enclosing said circular disks. Further, the bottom plate of the burner crown element 14 may have other geometric structures. For example, the bottom plate of the burner crown element 14 may be elongated, rectangular or elliptic.

The gas burner assembly 10 mentioned above includes two burner bases 11 and 12, wherein the bottom plate 14 of the burner crown element 14 includes the two adjacent circular disks and two side walls 28 enclosing said circular disks. Further, the gas burner assembly 10 may include three burner bases, wherein the bottom plate 14 of the burner crown element 14 may have substantially a triangular form. In this case, the flame ports 30 may be arranged at the outer corners of the triangular burner crown element. In a similar way, the gas burner assembly 10 may include four burner bases, wherein the bottom plate 14 of the burner crown element 14 may have substantially a rectangular or square form, wherein the flame ports 30 may be arranged at the outer corners of the rectangular or square burner crown element. In this way, the gas burner assembly 10 may comprises a higher number of burner bases, wherein the shape of the burner crown element 14 is adapted to the arrangement of the burner bases.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 gas burner assembly
11 first burner base
12 second burner base
14 burner crown element
16 burner cap
18 gas supply inlet
20 spark generator
22 thermocouple element
24 bottom plate
26 opening
28 side wall
30 flame port
32 pipe socket
34 pan
36 separating plate
38 pot

What is claimed is:

1. A gas burner assembly for a cooking hob, wherein
the gas burner assembly comprises at least two burner bases arranged side-by-side,
the gas burner assembly comprises a burner crown element arranged or arrangeable above the at least two burner bases,
the gas burner assembly comprises at least one burner cap arranged or arrangeable above the burner crown element,
the at least two burner bases are adjustable separately,
the burner crown element includes a bottom plate subdivided into at least two portions arranged side-by-side,
each portion of the bottom plate is arranged or arrangeable above one of the at least two burner bases,
the burner crown element includes at least two side walls,
each side wall encloses one of the at least two portions of the bottom plate,
the burner crown element includes a plurality of flame ports formed in the side walls,
the flame ports are arranged in sections of the side walls arranged opposite to the adjacent portion or portions of the bottom plate,
the bottom plate of the burner crown element includes two circular portions arranged side-by-side, so that the burner crown element, the bottom plate of said burner crown element, the side walls enclosing said bottom plate and/or the burner cap are eight-shaped, and
the flame ports are arranged only at two opposite small sides of the burner crown element.

2. The gas burner assembly according to claim 1,
wherein the portions of the bottom plate are circular or segments of circles.

3. The gas burner assembly according to claim 1,
wherein the flame ports are recesses at the upper edges of the side walls.

4. The gas burner assembly according to claim 1,
wherein the gas burner assembly comprises at least two chambers, wherein each chamber is formed by one of the portions of the bottom plate, by the side wall enclosing said portion and by the burner cap above said portion.

5. The gas burner assembly according to claim 1,
wherein the burner crown element is formed as a single-piece part.

6. The gas burner assembly according to claim 1,
wherein the burner cap is formed as a single-piece part.

7. The gas burner assembly according claim 1,
wherein the at least two burner bases are identical in construction.

8. The gas burner assembly according to claim 7,
wherein the at least two burner bases are rotated around a vertical axis relative to each other, so that the gas burner assembly is symmetric in view of a rotation around a vertical axis of 360°/N, wherein N defines the number of burner bases.

9. The gas burner assembly according to claim 1, wherein each burner base comprises at least one spark generator and/or at least one thermocouple element.

10. The gas burner assembly according to claim 1, wherein the burner bases are made of aluminium cast.

11. The gas burner assembly according to claim 1, wherein the burner crown element is made of aluminium cast.

12. The gas burner assembly according to claim 1, wherein the burner cap is made of enamelled steel or cast iron.

13. A cooking hob, in particular a domestic cooking hob, wherein the cooking hob includes at least one gas burner assembly according to claim 1.

* * * * *